US006496675B1

(12) United States Patent
Sugiyama et al.

(10) Patent No.: US 6,496,675 B1
(45) Date of Patent: Dec. 17, 2002

(54) MAGNET ROLLER

(75) Inventors: Noriyosi Sugiyama; Yuitiro Tengo; Taihei Goto, all of Kanagawa-ken (JP)

(73) Assignee: Kabushiki Kaisha Bridgestone, Tokyo (JP)

( * ) Notice: Subject to any disclaimer, the term of this patent is extended or adjusted under 35 U.S.C. 154(b) by 35 days.

(21) Appl. No.: 09/686,079

(22) Filed: Oct. 12, 2000

(30) Foreign Application Priority Data

| | | |
|---|---|---|
| Oct. 14, 1999 | (JP) | 11-291769 |
| Oct. 22, 1999 | (JP) | 11-300754 |
| Dec. 27, 1999 | (JP) | 11-369998 |
| Jan. 20, 2000 | (JP) | 2000-011489 |

(51) Int. Cl.[7] ..... G03G 15/09
(52) U.S. Cl. ..... 399/277; 492/8
(58) Field of Search ..... 399/277, 267, 399/273; 492/8; 29/895.33; 264/DIG. 58; 335/302, 306

(56) References Cited

U.S. PATENT DOCUMENTS

| | | | | |
|---|---|---|---|---|
| 4,331,100 A | * | 5/1982 | Mochizuki et al. | 399/277 |
| 4,354,454 A | * | 10/1982 | Nishikawa | 399/277 |
| 4,517,719 A | * | 5/1985 | Okumura et al. | 492/8 |
| 4,806,971 A | * | 2/1989 | Masham | 399/277 |
| 5,044,313 A | * | 9/1991 | Yuge et al. | 399/103 |
| 5,212,344 A | * | 5/1993 | Kageyama et al. | 399/274 |
| 6,021,296 A | * | 2/2000 | Tamura et al. | 399/277 |
| 6,070,038 A | * | 5/2000 | Imamura et al. | 399/277 |

FOREIGN PATENT DOCUMENTS

| | | | |
|---|---|---|---|
| JP | 03-216687 | * | 9/1991 |
| JP | 11-249436 | * | 9/1999 |

* cited by examiner

*Primary Examiner*—Robert Beatty
(74) *Attorney, Agent, or Firm*—Sughrue Mion, PLLC

(57) ABSTRACT

A magnet roller comprises a magnet body integrally molded out of a resin magnet composition prepared by mixing and dispersing magnetic powders in a resin binder and a shaft portion projecting from both ends or one end in an axial direction of the magnet body and has a magnetization pattern with a zero-gauss zone between a pair of magnetic poles having the same polarity which are adjacent to each other in a circumferential direction, wherein a cut-out portion extending in an axial direction is formed on the side of the magnetic body at the predetermined position of the zero-gauss zone.

8 Claims, 9 Drawing Sheets

X;PREDETERMINED POSITION OF ZERO-GAUSS ZONE

MAGNET ROLLER

BACKGROUND OF THE INVENTION

1. Field of the Invention

The present invention relates to a magnet roller for use in the developing unit of an electrophotographic device or electrostatic recording device using magnetic toner.

2. Description of the Prior Art

Heretofore, in the field of electrophotographic devices and electrostatic recording devices such as copiers, printers and facsimiles, there has been known a developing method which comprises forming an electrostatic latent image on a latent image holder such as a photosensitive drum and visualizing the electrostatic latent image by supplying magnetic toner to the electrostatic latent image by means of a developing device.

FIG. 16 is a diagram showing the constitution of a conventional developing device 40. The developing device 40 comprises a developing roller 50 which contains a cylindrical magnet roller 52 magnetized to a predetermined magnetizing pattern in a rotating cylindrical sleeve 51. The developing device 40 sucks up magnetic toner T stored in a developing container 53 to the surface of the sleeve 51 based on the magnetizing pattern and carries it, forms a uniform thin layer of the magnetic toner T by means of a layer forming blade 54, and supplies the magnetic toner T on an electrostatic latent image on the surface of a photosensitive drum 60 to visualize it by a so-called jumping phenomenon that the magnetic toner 5 is jumped on the photosensitive drum 60 by the magnetic force characteristics of the magnet roller 52. The magnetic toner T remaining on the surface of the sleeve 51 is separated from the sleeve 51 and collected thereafter.

In the magnet roller 52, the above magnetizing pattern is designed such that a sucking pole 52*a* for sucking up the magnetic toner T and a collection pole 52*b* for separating the magnetic toner T are made the same in polarity to carry out the collection and sucking of the magnetic toner T by repulsive force between the two poles. A zero-gauss zone where the peak magnetic force becomes 100 gauss or less is formed between the above two poles to separate them from each other to improve the recovery of the remaining magnetic toner T.

The above magnet roller 52 is produced by injection molding or extrusion molding into a roll form a pellet-shaped bond magnetic composition prepared by mixing magnetic powders such as ferrite with a thermoplastic resin such as nylon or polypropylene using a metal mold having a magnetic field formed around a cavity and magnetizing the surface of the roll to a desired magnetization pattern.

Various magnetization patterns are required of the magnet roller according to the specifications of a copier. Therefore, besides the above-described magnet roller produced by magnetizing a roller integrally molded out of a bond magnet composition to a desired magnetization pattern, a cylindrical magnet roller produced by joining together a plurality of bar-shaped magnet pieces whose outer magnetic poles have been made N or S poles by magnetization and whose section is fan-shaped in such a manner that sides of the magnet pieces are contacted to one another.

Along with recent progress in electrophotographic devices and the like, a more complicated magnetization pattern has been desired of a magnet roller. The magnet roller of the prior art has a limit in the design of a magnetization pattern and cannot meet such demand in some cases. Particularly in a magnet roller having a magnetization pattern in which a zone where the peak magnetic force becomes 100 gauss or less (to be referred to as "zero-gauss zone" hereinafter) is formed at almost an intermediate position between the adjacent poles of the magnetization pattern, the pole positions after magnetization are shifted from predetermined pole positions (designed pole positions) by production differences including a difference in the orientation of magnetic powders at the time of molding, whereby the dislocation of the zero-gauss zone of the magnetization pattern occurs and it is difficult to obtain a magnet roller having a desired magnetization pattern. Therefore, when development is carried out with a developing roller comprising a magnet roller having a magnetization pattern with a dislocated zero-gauss zone, a clear image cannot be obtained.

This problem is also seen in the above-described magnet roller constructed by joining together a plurality of magnet pieces. Since the zero-gauss zone is dislocated by differences in magnetization state among the magnet pieces, a desired magnetization pattern cannot be obtained.

SUMMARY OF THE INVENTION

It is an object of the present invention which has been made in view of the above problems of the prior art to provide a magnet roller having a magnetization pattern which rarely experiences the dislocation of a zero-gauss zone though it is simple in structure.

According to a first aspect of the present invention, there is provided a magnet roller which comprises a magnet body integrally molded out of a resin magnet composition prepared by mixing and dispersing magnetic powders in a resin binder and a shaft portion projecting from both ends in an axial direction of the magnet body and which has a magnetization pattern with a zero-gauss zone between a pair of magnetic poles having the same polarity which are adjacent to each other in a circumferential direction (for example N and N poles in a magnet roller having N-S-N-N-S poles), wherein a cut-out portion extending in an axial direction is formed on the side of the magnet body at the predetermined position of the zero-gauss zone. Thereby, the position of the zero-gauss zone can be stabilized by suppressing a change in magnetic force between the above magnet poles having the same polarity.

According to a second aspect of the present invention, there is provided a magnet roller, wherein the size of the cross section of the cut-out portion is 5% or more of the cross-sectional area of the magnet body.

According to a third aspect of the present invention, there is provided a magnet roller, wherein an area having a difference of 40 gauss or less from the minimum magnetic force point of the magnetization pattern in the zero-gauss zone is 30° or more in terms of the angle of the roller.

According to a fourth aspect of the present invention, there is provided a magnet roller, wherein the number of magnetic poles of the magnetization pattern is an odd number.

According to a fifth aspect of the present invention, there is provided a magnet roller which comprises a magnet body constructed by arranging in a circumferential direction a plurality of magnet pieces molded out of a resin magnet composition prepared by mixing and dispersing magnetic powders in a resin binder and shaft portions projecting from both ends in an axial direction of the magnet body and which has a magnetization pattern with a zero-gauss zone between a pair of magnet pieces adjacent to each other in a circumferential direction, wherein the magnet pieces are arranged in such a manner that the joint between the adjacent magnet pieces of two magnet poles is located at the predetermined position of the zero-gauss zone to stabilize the position of the zero-gauss zone.

According to a sixth aspect of the present invention, there is provided a magnet roller, wherein the difference of angle between the position of the zero-gauss zone and the position of the joint is 30° or less.

According to a seventh aspect of the present invention, there is provided a magnet roller which comprises a magnet body constructed by arranging in a circumferential direction a plurality of magnet pieces molded out of a resin magnet composition prepared by mixing and dispersing magnet powders in a resin binder and shaft portions projecting from both ends in an axial direction of the magnet body and which has a magnetization pattern with a zero-gauss zone between a pair of magnet pieces adjacent to each other in a circumferential direction, wherein a space is formed between the above adjacent magnet pieces of two magnetic poles and located at the predetermined position of the zero-gauss zone to stabilize the position of the zero-gauss zone.

According to an eighth aspect. of the present invention, there is provided a magnet roller, wherein rare earth alloy powders are used as the magnetic powders to obtain high magnetic force even when the roller has a small diameter.

According to a ninth aspect of the present invention, there is provided a magnet roller, wherein the rare earth alloy powders are anisotropic rare earth alloy powders.

According to a tenth aspect of the present invention, there is provided a magnet roller, wherein the anisotropic rare earth alloy powders are any one of anisotropic Sm—Fe—N alloy powders and anisotropic Nd—Fe—B alloy powders or a mixture thereof.

The above and other objects, features and advantages of the invention will become more apparent from the following description when taken in conjunction with the accompanying drawings.

BRIEF DESCRIPTION OF THE ACCOMPANYING DRAWINGS

DETAILED DESCRIPTION OF THE PREFERRED EMBODIMENTS

Preferred embodiments of the present invention will be described hereinafter with reference to the accompanying drawings.

Embodiment 1

Figure 1:
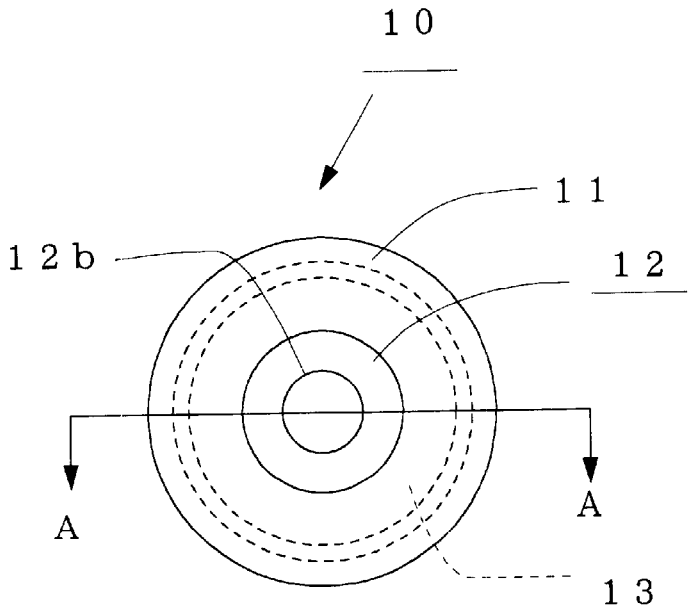
FIG. 1 is a front view showing the constitution of a developing roller comprising a magnet roller according to Embodiment 1 of the present invention.
Figure 2:
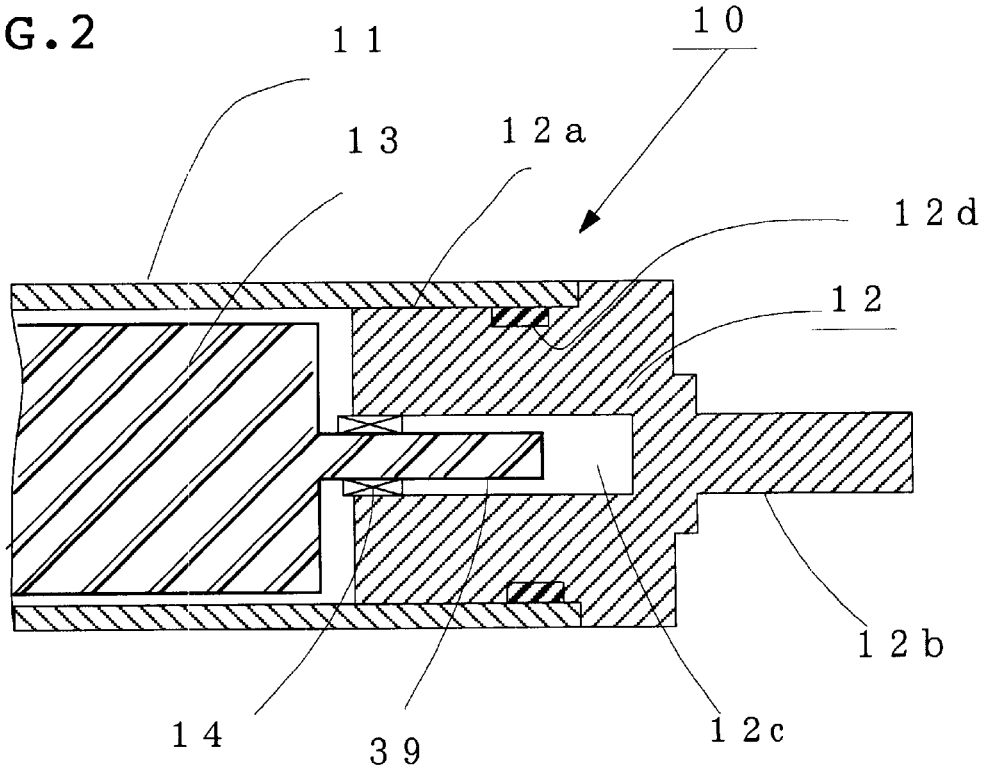
FIG. 2 is a sectional view showing the constitution of the developing roller according to Embodiment 1 of the present invention.

FIG. 1 and FIG. 2 are diagrams showing the constitution of a developing roller 10 comprising a magnet roller according to Embodiment 1 of the present invention. FIG. 1 is a front view and FIG. 2 is a sectional view cut on line A—A of FIG. 1. The developing roller 10 comprises a cylindrical sleeve 11 made from a non-magnetic material, a holder 12, mated with both ends of the sleeve 11, for fixing the sleeve 11, and a columnar magnet roller 13 installed in the sleeve 11 coaxially and magnetized to a designed magnetization pattern.

The holder 12 is a stepped column having a stepped portion 12*a* whose diameter on the sleeve 11 side is smaller by the thickness of the sleeve 11, cylindrical shafts 12*b* projecting outward from a center portion of the outer end surface, and cylindrical recessed portions 12*c*, formed in a center portion of the inner end surface, for accepting the shaft portions 39 of the magnet roller 13. Both end portions of the sleeve 11 is fixed to the holder 12 by an adhesive or the like in fixing portions 12*d* formed in the stepped portion 12*a* of the holder 12.

The magnet roller 13 comprises a columnar magnet body 30 magnetized to a predetermined magnetization pattern and columnar shaft portions 39 which project from both ends of the magnet body 30 and whose projecting portions are inserted into the recessed portions 12*c*. Both ends of the shaft portions 39 are connected to the holder 12 through bearings 14.

The above magnet roller 13 is available in the following four types according to the relationship between the magnet body 30 and the shaft portions 39. The magnet roller of the present invention may be any one of them.

(1) A shaft-integrated type in which the magnet body and the shaft portion are integrally molded out of a bond magnet composition.

(2) A one shaft insertion type in which the magnet body and one shaft portion are integrally molded out of a bond magnet composition and the other shaft portion is inserted into the holder.

(3) A both shaft insertion type in which the magnet body is integrally molded out of a bond magnet composition and the both shaft portions are inserted into the holder.

(4) A shaft insertion type in which the magnet body is integrally molded out of a bond magnet composition and is made hollow and a shaft portion is inserted into the hollow portion of the magnet body.

In the magnet rollers (2) to (4), the shaft used to be inserted is available in various types and shafts which have been commonly used in magnet rollers may be used. The shafts include metal solid shafts, hollow shafts and resin shafts.

Figure 3:
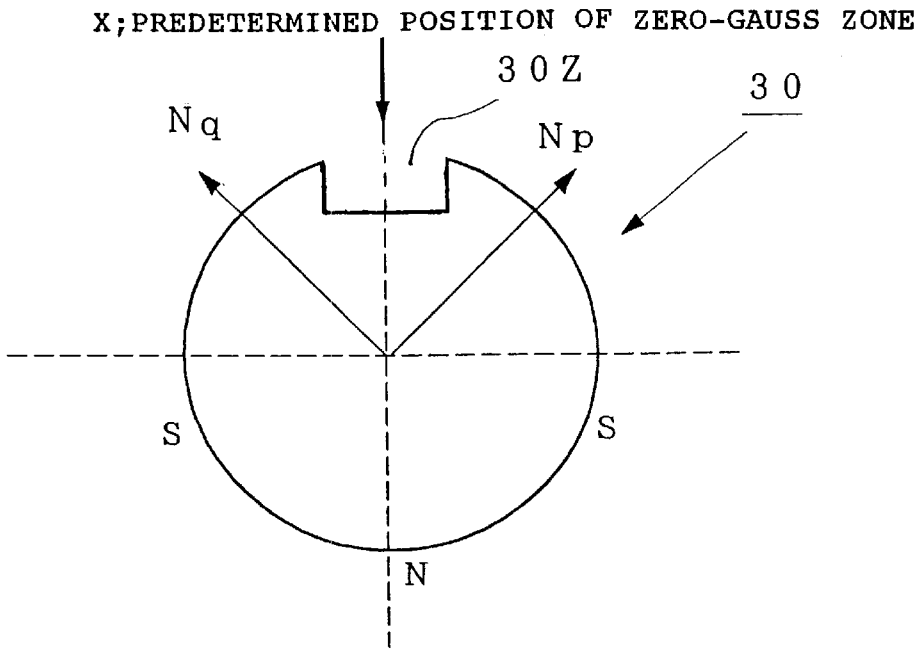
FIG. 3 is a diagram showing the constitution of the magnet roller according to Embodiment 1 of the present invention.

The above magnet body 30 of the magnet roller 13 has a magnetization pattern having a pair of magnetic poles (Np-Nq poles) which are adjacent to each other and have the same polarity, such as N-S-Np-Nq-S poles as shown in FIG. 3, and a cut-out portion 30Z which is as large as 5% or more of the cross-sectional area of the magnet body 30 is formed in the side surface of the magnet body 30 in an axial direction at a position including a center portion in a circumferential direction between the pair of adjacent magnetic poles having the same polarity, that is, the predetermined position of the zero-gauss zone. The Np pole serves as a sucking pole and the Nq pole serves as a collection pole.

In the present invention, the size of the cross section of the above cut-out portion 30Z is desirably 5% or more, preferably 10% or more, particularly preferably 10 to 30% of the cross-sectional area of the magnet body 30 before the cut-out portion 30Z is formed. This is because when the size is smaller than 5%, a desired magnetization pattern, that is, a magnetization pattern having a stabilized zero-gauss zone cannot be obtained and when the cut-out portion 30Z is made too large, a reduction in magnetic force is marked and not practical.

The cross section of the above cut-out portion 30Z (strictly speaking, the shape of the cut edge portion) may be various in shape, for example, substantially a shape such as that having a base and two uprights at either side, U-shaped or V-shaped. When the cross section of the cut-out portion 30Z has substantially a shape such as that having a base and two uprights at either side, the width (length in a direction perpendicular to the radius from the center of the axis) and depth (length in a radial direction from the center of the axis) of the cut-out portion 30Z are not particularly limited but the depth of the above cut-out portion 30Z should be 100% or less of the radius from the periphery of the magnet body 30 to the center (center of the axis).

Figure 4:
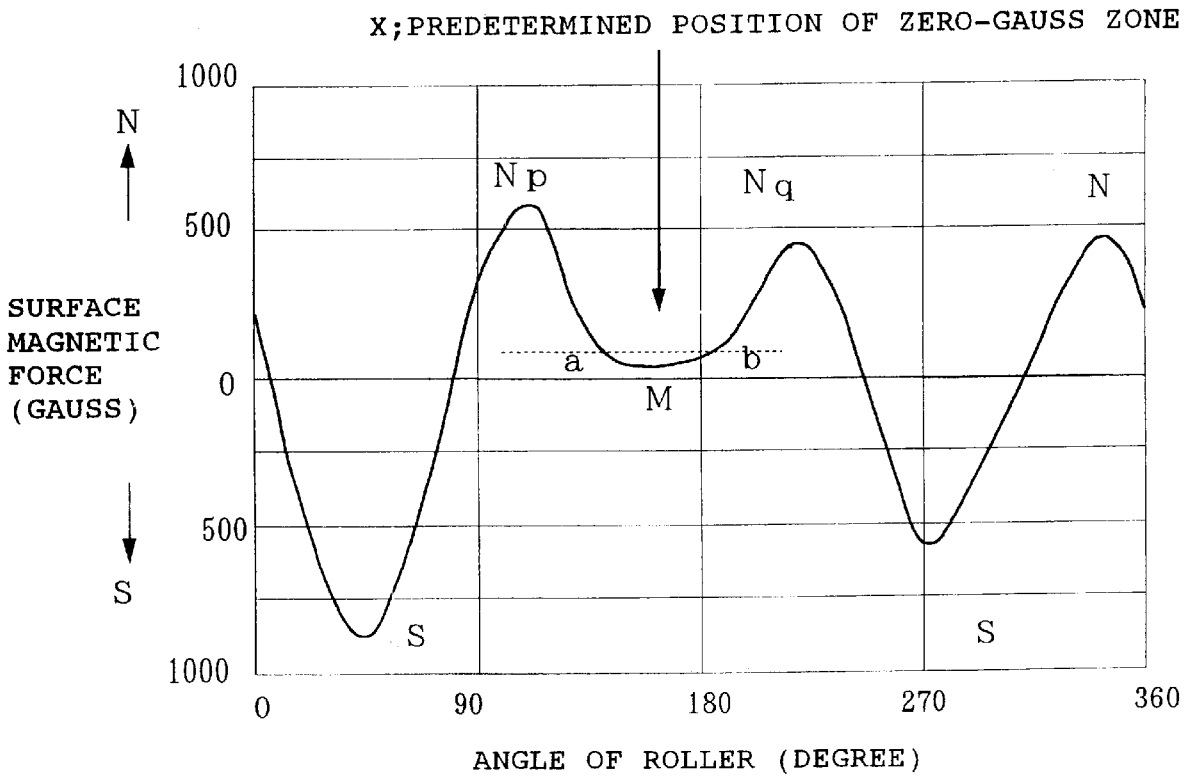
FIG. 4 is a diagram showing the magnetization pattern of the magnet roller according to Embodiment 1 of the present invention.

FIG. 4 shows the magnetization pattern of the magnet roller 13 having the above N-S-Np-Nq-S poles. An area (between "a" and "b") having a difference of 40 gauss or less from the minimum magnetic force point (M) in the zero-gauss zone set between a pair of adjacent magnetic poles having the same polarity (Np-Nq poles) is wide at 30° or more in terms of the angle of the roller (phase difference). That is, since the cut-out portion 30Z is formed in the magnet roller 13 of Embodiment 1, the magnetization pattern between the adjacent magnetic poles of the same polarity can be made relatively flat, making it possible to locate the zero-gauss zone at a predetermined position. Therefore, when the magnet roller 13 is used in a developing roller, for example, a clear image can be obtained.

The magnetization pattern of the magnet body 30 is not limited to the above magnetization pattern (N-S-N-N-S poles) but may be S-N-S-S-N poles, N-S-N-N-S-N-S poles or N-S-S poles which has a pair of adjacent magnetic poles having the same polarity. The number of magnetic poles is preferably an odd number, more preferably 3, 5 or 7, particularly preferably 5.

The magnet roller 13 of Embodiment 1 is molded out of a bond magnet composition. The bond magnet composition is prepared by dispersing magnetic powders in a resin binder. The resin binder is not particularly limited and may be optionally selected from among those which have been commonly used in magnet rollers. Illustrative examples of the resin binder include polyamide resins such as nylon 6 and nylon 12, polystyrene resin, polyethylene terephthalate resin (PET), polybutylene terephthalate resin (PBT), polyphenylene sulfide resin (PPS), ethylene-vinyl acetate copolymer resin (EVA), ethylene-ethyl acrylate copolymer resin (EEA), epoxy resin, ethylene-vinyl alcohol copolymer resin (EVOH), polyolefins such as polypropylene resin, polyethylene and polyethylene copolymers and modified polyolefins obtained by introducing a functional group having reactivity such as a maleic anhydride group, carboxyl group, hydroxyl group or glycidyl group into the structures of these polyolefins. Out of these, polyamide resins and EEA are particularly preferred. These resin binders may be used alone or in combination of two or more.

The magnetic powders are not particularly limited and may be optionally selected from among those which have been commonly used in magnet rollers. Illustrative examples of the magnetic powders include magnetic ferrite powders such as strontium ferrite, barium ferrite and lead ferrite, and rare earth magnetic alloy powders such as Sm—Co alloy, Nd—Fe—B alloy and Ce—Co alloy. These magnetic powders may be used alone or in combination of two or more.

When the magnet roller 13 is a small roller having a diameter of 20 mm or less, a rare earth alloy is desirably used as the magnetic powders. When an anisotropic rare earth alloy such as an anisotropic Sm—Fe—N alloy or anisotroic Nd—Fe—B alloy is used, sufficient magnetic force can be obtained and even when the number of magnetic poles is large, high magnetic force can be obtained.

The average particle diameter of the magnetic powders is not limited but it is preferably 1 to 500 $\mu$m, particularly preferably 2 to 200 $\mu$m. The blending ratio of the resin binder to the magnetic powders in the bond magnet composition is not particularly limited and suitably selected according to the required magnetic force of the magnet roller. The amount of the magnetic powders is preferably 80 to 95 wt % (density of 3.0 to 4.0 g/cm$^3$) based on the total weight of the bond magnet composition.

The above bond magnet composition may further contain a filler having a large reinforcing effect such as mica, talc, fiber such as carbon fiber or glass fiber, or whisker as required. That is, when magnetic force required of a molded product is relatively low and the amount of the magnetic powders is small, the rigidity of the molded product tends to be low. In this case, to compensate for rigidity, a filler such as mica or whisker can be added to reinforce a molded product. The filler is preferably mica or whisker. Examples of the whisker include non-oxide whiskers such as silicon carbide and silicon nitride whiskers, metal oxide whiskers such as ZnO, MgO, $TiO_2$, $SnO_2$ and $Al_2O_3$ whiskers, and composite oxide whiskers such as potassium titanate, aluminum borate and basic magnesium sulfate whiskers. Out of these, composite oxide whiskers are preferred because compounding with plastics is easy.

When a filler is used, the amount of the filler is not particularly limited but it is generally 2 to 32 wt %, preferably 5 to 20 wt % based on the total weight of the bond magnet composition.

The method of preparing the above bond magnet composition is not particularly limited. For example, a resin binder and magnetic powders and optionally a filler are mixed together in accordance with a commonly used method, melt kneaded together and formed into pellets to prepare a bond magnet composition. General melt kneading methods and conditions using a double-screw kneading extruder or KCK kneading extruder may be adopted.

To produce the magnet roller 13 of Embodiment 1, a magnet roller 13 without a cut-out portion 30Z may be formed by injection molding using a general metal mold, and a desired cut-out portion 30Z may be formed by cutting out a predetermined position of the magnet body 30. From the viewpoint of simplifying the production process and saving materials, a core corresponding to the cut-out portion 30Z to be formed is arranged at a predetermined position in the metal mold and the bond magnet composition is injected into the metal mold to mold the magnet roller 13 having the desired cut-out portion 30Z.

The magnet roller 13 of Embodiment 1 can be produced by a commonly used method other than the above method. The method of magnetization is not particularly limited. For example, when the magnet body 30 is to be molded with a metal mold, a magnetic field is formed around the cavity of the metal mold to magnetize the magnet body 30 to a desired magnetization pattern at the same time as molding. Or, a magnetic field is formed around the cavity of the metal mold to align the magnetic powders in a desired direction, a roller is formed by demagnetizing the magnetic powders, and a magnetizer is used to magnetize the roller to a desired magnetization pattern.

EXAMPLES

The following examples are given to further illustrate the present invention.

Figure 5:
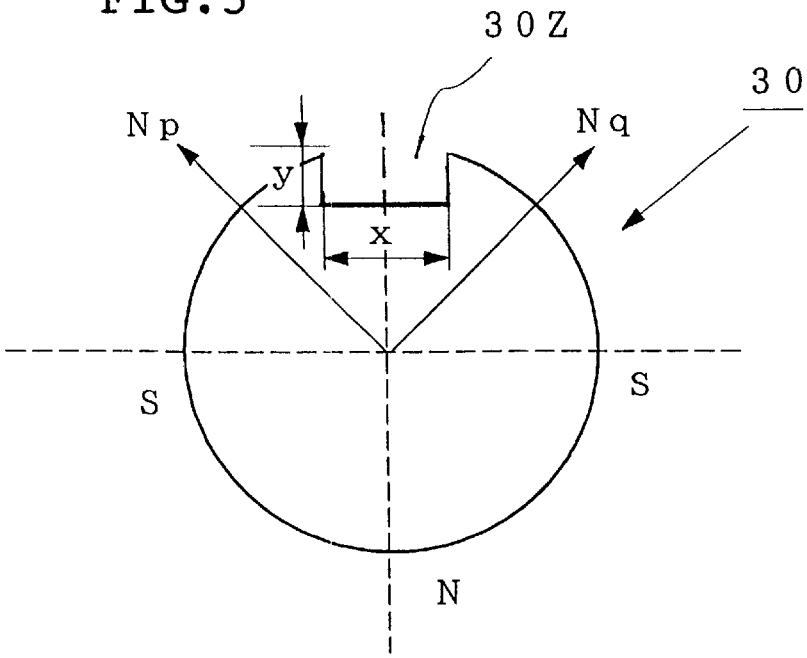
FIG. 5 is a diagram showing how to form a cut-out portion of the magnet roller according to Embodiment 1 of the present invention.

A bond magnet composition comprising 10 wt % of an ethylene-ethyl acrylate copolymer as a binder and 90 wt % of strontium ferrite powders as magnetic powders was injected into a cavity in a mold around which a magnetic field was formed at a cylinder temperature of 245° C., a metal mold temperature of 65° C. and an injection pressure of $6.86\times10^7$ Pa (700 kg/cm$^2$) to produce a shaft-integrated magnet roller (Examples 1 to 10) comprising a cylindrical magnet body 30 having a diameter of 14 mm and a length of 315 mm and a shaft portion 39 projecting from both ends of the magnet body 30 and having a diameter of 6 mm and a length of 30 mm. Thereafter, as shown in FIG. 5, a cut-out portion 30Z having a predetermined width (x) and depth (y) and a cross section having a shape such as that having a base and two uprights at either side was formed around a center portion in a circumferential direction between Np and Nq poles in an axial direction. A conventional magnet roller without a cut-out portion 30Z was produced as Comparative Example 1 and magnet rollers whose cut-out portion 30Z is as large as 5% or less of the cross-sectional area of the magnet body 30 were produced as Reference Examples 1 and 2.

Magnetization patterns of Examples 1 to 10, Comparative Example 1 and Reference Examples 1 and 2 were measured to calculate the size of an area having a difference of 40 gauss or less from the minimum magnetic force point M of the magnetization pattern between Np-Nq poles from the angle of the roller, and developing rollers were produced using the obtained magnet rollers and installed in electrophotographic devices (copiers) to carry out copying. The results are shown in Table 1 below.

Figure 6:
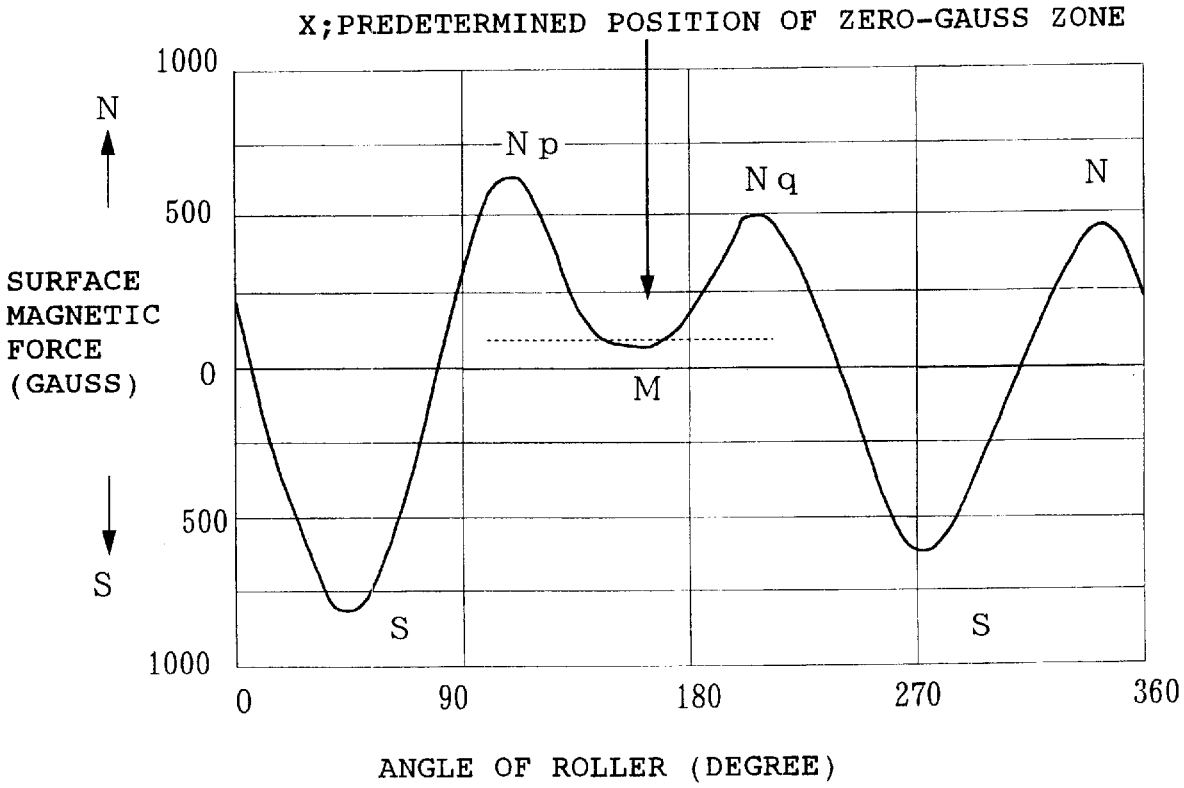
FIG.6 PRIOR ART
FIG. 6 is a diagram showing the magnetization pattern of a conventional magnet roller.

FIG. 6 shows the magnetization pattern of the above conventional magnet roller. The magnetic flux density at the minimum magnetic force point M of the magnetization pattern between Np-Nq poles was approximately 88 gauss and the size of the area having a difference of 40 gauss or less from the minimum magnetic force point M was 26.64° in terms of the angle of the roller.

TABLE 1

| | WIDTH OF CUT-OUT PORTION (mm) | DEPTH OF CUT-OUT PORTION (mm) | AREA RATIO OF CUT-OUT PORTION (%) | ANGLE OF 40 G WIDTH (deg.) | IMAGE |
|---|---|---|---|---|---|
| COMPARISON EXAMPLE 1 | 0 | 0 | 0 | 26.64 | UNCLEAR |
| PRESENT INVENTION 1 | 8 | 2 | 11.0 | 43.20 | CLEAR |
| PRESENT INVENTION 2 | 8 | 3.5 | 19.3 | 54.36 | CLEAR |
| REFERENCE EXAMPLE 1 | 6 | 1 | 4.1 | 27.36 | UNCLEAR |
| PRESENT INVENTION 3 | 6 | 2 | 8.3 | 36.72 | CLEAR |
| PRESENT INVENTION 4 | 6 | 3 | 12.4 | 44.28 | CLEAR |
| PRESENT INVENTION 5 | 6 | 4 | 16.5 | 45.72 | CLEAR |
| PRESENT INVENTION 6 | 6 | 4.5 | 18.6 | 43.58 | CLEAR |
| REFERENCE EXAMPLE 2 | 4 | 1 | 2.8 | 27.36 | UNCLEAR |
| PRESENT INVENTION 7 | 4 | 2 | 5.5 | 34.20 | CLEAR |
| PRESENT INVENTION 8 | 4 | 3 | 8.3 | 35.64 | CLEAR |
| PRESENT INVENTION 9 | 4 | 4 | 11.0 | 35.34 | CLEAR |
| PRESENT INVENTION 10 | 4 | 5.2 | 14.3 | 32.40 | CLEAR |

As shown in Table 1, when the conventional magnet roller was used, the obtained image was unclear whereas when the magnet rollers obtained in Examples 1 to 10 were used, the obtained images were all clear. When the magnet rollers of Reference Examples 1 and 2 whose cut-out portions 30Z were as large as 5% or less were used, the obtained images were unclear.

Embodiment 2

In the above Embodiment 1, a magnet roller produced by magnetizing a roller integrally molded out of a bond magnet composition to a desired magnetization pattern has been described. A magnet roller produced by joining together a plurality of bar-like magnet pieces whose outer magnetic poles have been made N or S poles by magnetization and whose section is fan-shaped in such a manner that the sides of the magnet pieces are contacted to one another, which rarely experiences the dislocation of the zero-gauss zone, can be obtained by the same simple constitution as described above.

Figure 7:
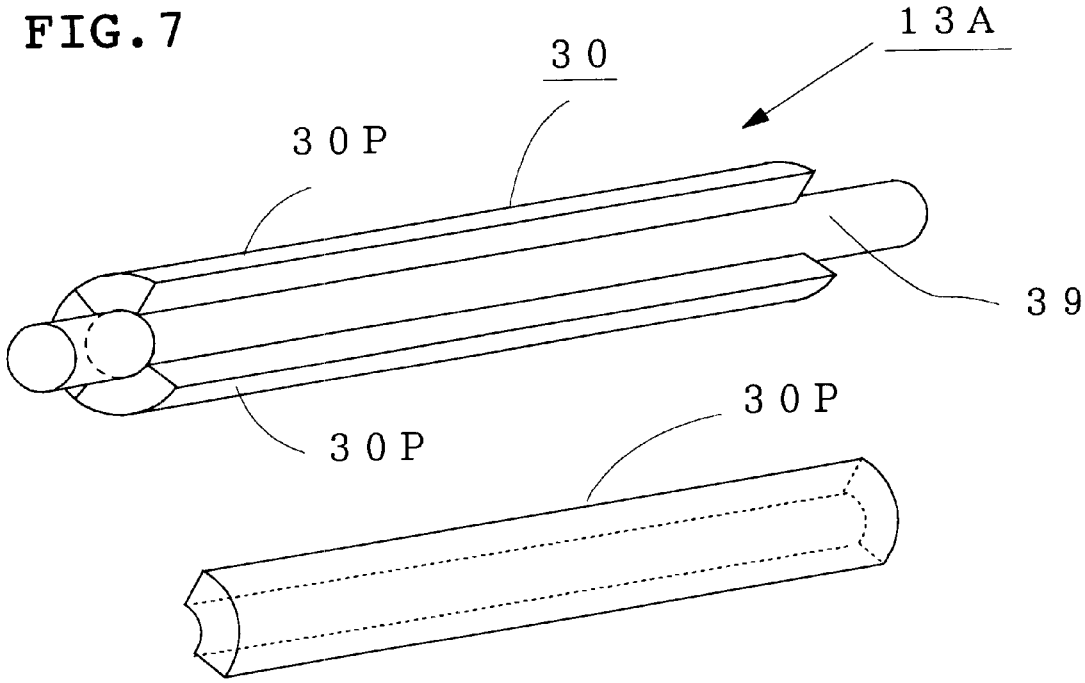
FIG. 7 is a perspective view showing the constitution of a magnet roller according to Embodiment 2 of the present invention.
Figure 8:
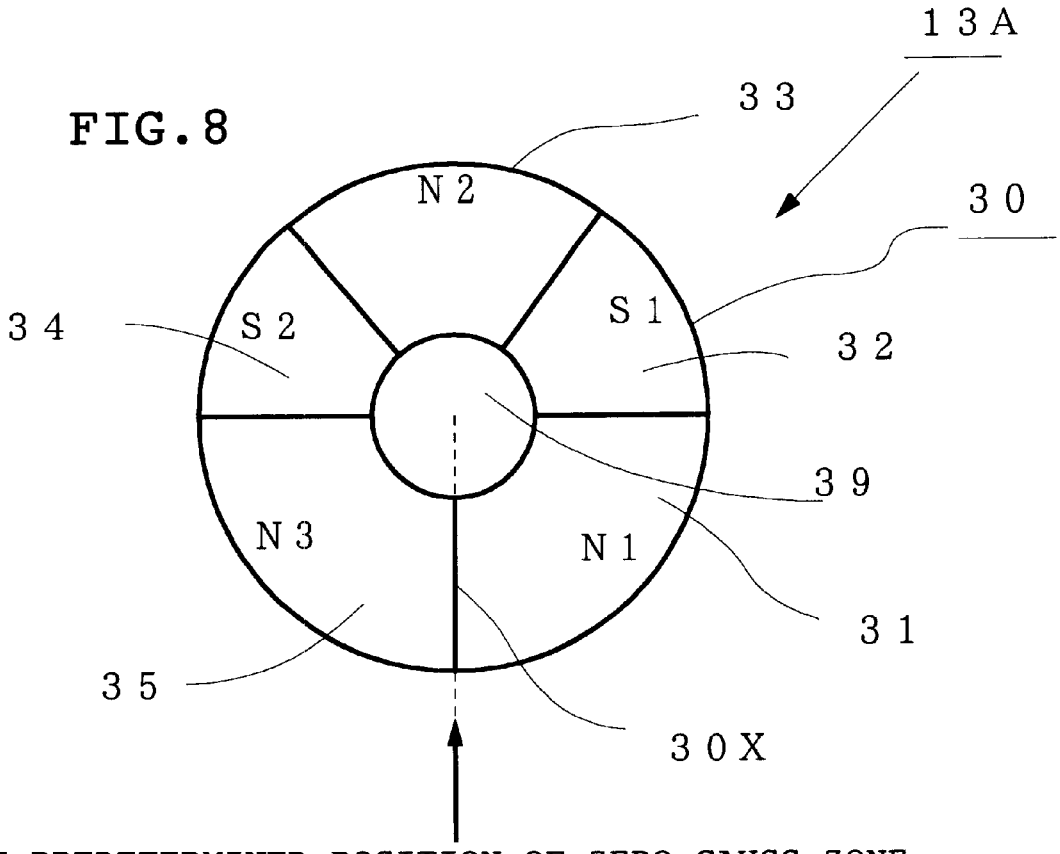
FIG. 8 is a front view showing the constitution of the magnet roller according to Embodiment 2 of the present invention.

FIG. 7 and FIG. 8 show the constitution of a magnet roller 13A according to Embodiment 2. The magnet body 30P of the magnet roller 13A is constructed by joining together bar-like magnet pieces 31 to 35 whose outer magnetic poles have been magnetized N1 (sucking pole), S1 (layer limiting pole), N2 (carrying pole), S2 (developing pole) and N3 (collecting pole) poles and whose section is fan-shaped in such a manner that the sides of the magnet pieces are contacted to each other around a shaft portion 39. That is, the magnet pieces 31 to 35 are arranged in a circumferential direction. Like the above Embodiment 1, the above magnet pieces 31 to 35 are obtained by forming a resin magnet composition prepared by dispersing magnetic powders of a ferrite-based sintered magnet such as strontium ferrite in a thermoplastic resin binder such as nylon, polyethylene or EVA (ethylene-vinyl acetate copolymer) by injection molding or the like and magnetizing the outer magnetic poles thereof predetermined magnetic poles.

Figure 9:
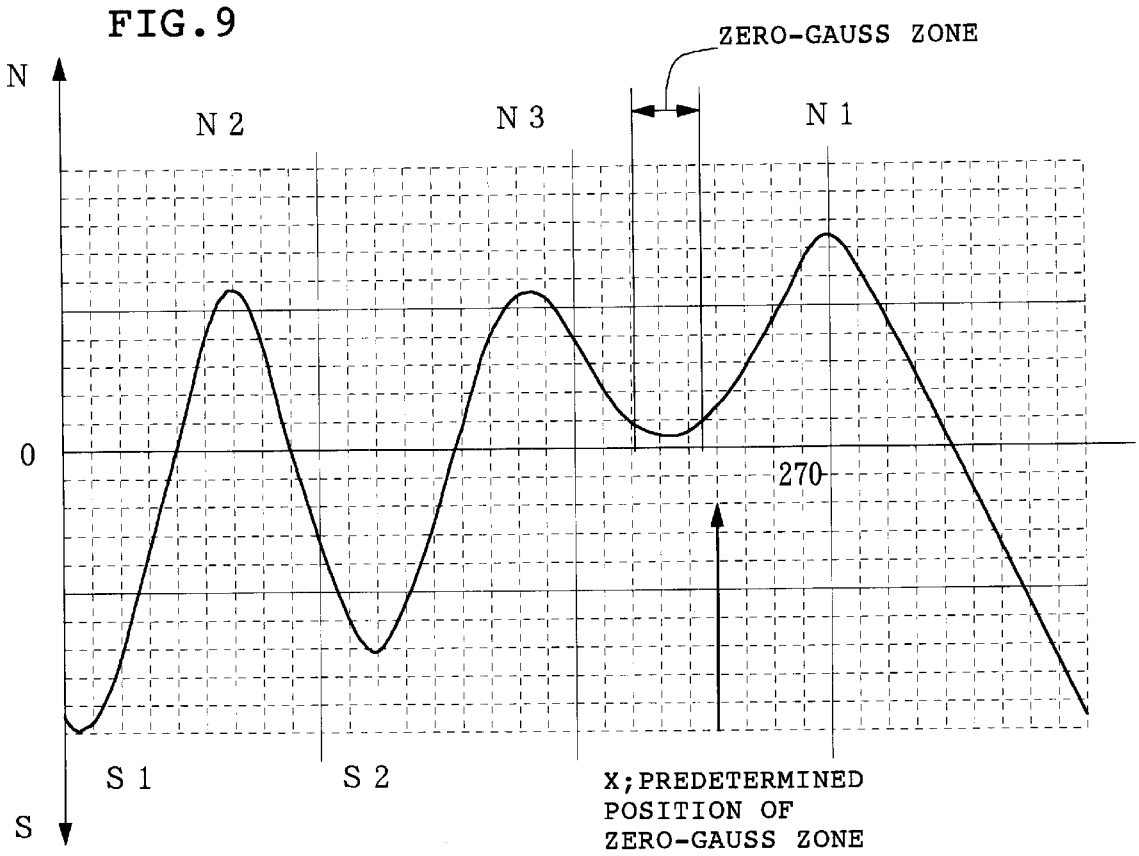
FIG. 9 is a diagram showing the magnetization pattern of the magnet roller according to Embodiment 2 of the present invention.

The magnetization pattern of the magnet roller 13A is designed to have a zero-gauss zone where the peak magnetic force becomes 100 gauss or less at almost an intermediate position between N3 and N1 poles, for example. In this Embodiment 2, as shown in FIG. 9, the magnet pieces 31 to 35 are arranged such that the joint 30X between a magnet piece 35 as a collection pole (N3 pole) and a magnet piece 31 as a sucking pole (N1 pole) is located at the design position of the zero-gauss zone shown by an arrow x to construct the magnet roller 13A. Thereby, the magnet roller 13A having a magnetization pattern with the actual zero-gauss zone at a position extremely close to the design position X of the zero-gauss zone can be obtained as shown in FIG. 7.

Since the joint 30X is composed of a non-magnetic adhesive layer and the polarities of the magnet piece 35 and the magnet piece 31 are the same, the size of magnetic force near the joint 30X becomes very small. Therefore, when the magnet roller 13A is constructed by joining together the magnet pieces 31 to 35 so that the joint 30X between the magnet piece 31 and the magnet piece 35 is located at the design position X of the zero-gauss zone, the size of magnetic force near the joint 30X can be reduced to 100 gauss or less without fail.

That is, since the magnet roller 13A of Embodiment 2 is constructed by joining together the magnet pieces 31 to 35 so that the joint 30X is located at the design position x of the zero-gauss zone, even when there are differences at the time of molding or magnetization, a magnetization pattern between the magnet piece 35 and the magnet piece 31 can be made relatively flat. Since the dislocation of the zero-gauss zone can be eliminated, when the magnet roller is used in a developing roller, a clear image can be obtained.

When the joint 30X between the magnet pieces is to be located at the design position X of the above zero-gauss zone, if the difference of angle between the design position X and the position of the joint 30X is 30° or less, the dislocation of the zero-gauss zone can be completely eliminated.

In the above Embodiment 2, the magnet roller 13A whose magnet pieces are magnetized N1, S1, N2, S2 and N3 poles has been described. The magnetization pattern of the magnet roller is not limited to this. In the above embodiment, the magnet roller 13 having 5 poles has been described. A magnet roller which has a different number of poles and rarely experiences the dislocation of the zero-gauss zone can be obtained by arranging the magnet pieces such that the joint between magnet pieces is located at the design position X of the zero-gauss zone.

Embodiment 3

Figure 10:
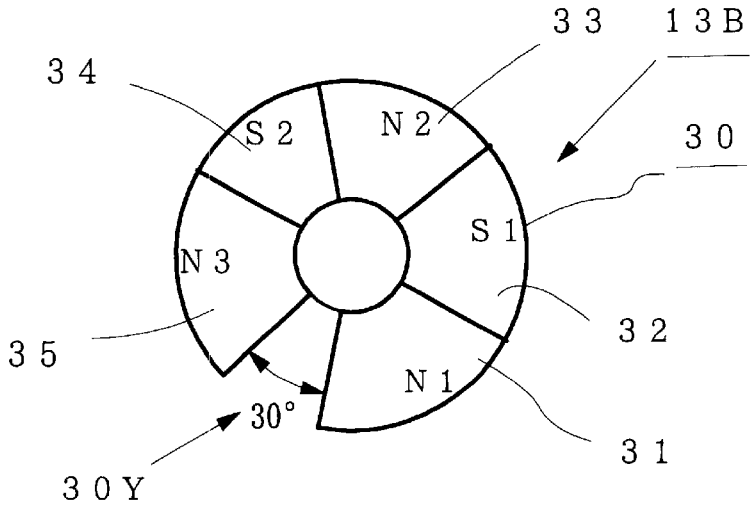
FIG. 10 is a front view showing the constitution of a magnet roller according to Embodiment 3 of the present invention.
Figure 11:
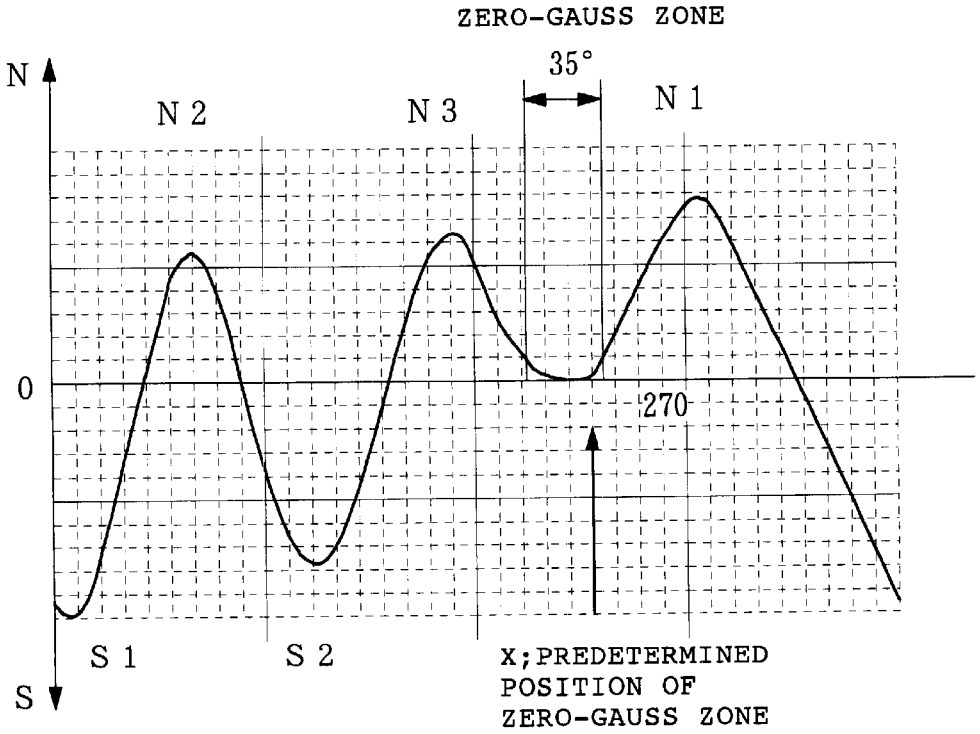
FIG. 11 is a diagram showing the magnetization pattern of the magnet roller according to Embodiment 3 of the present invention.
Figure 12:
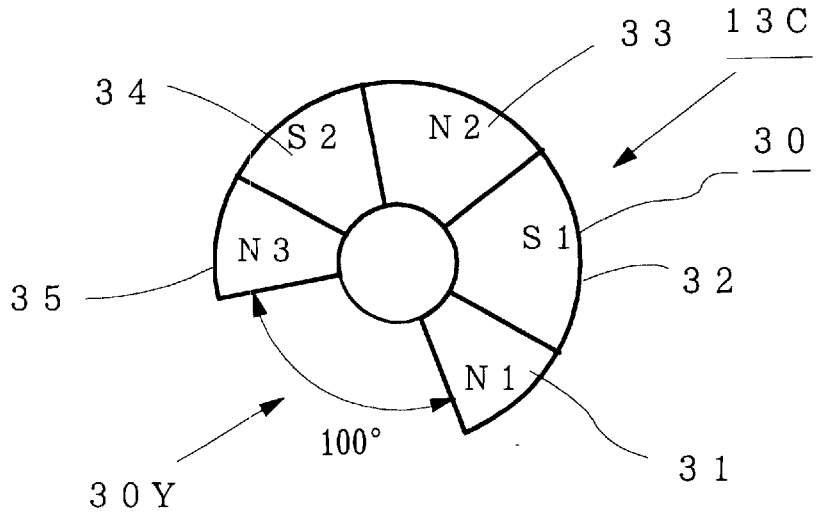
FIG. 12 is a front view showing the constitution of another magnet roller according to Embodiment 3 of the present invention.
Figure 13:
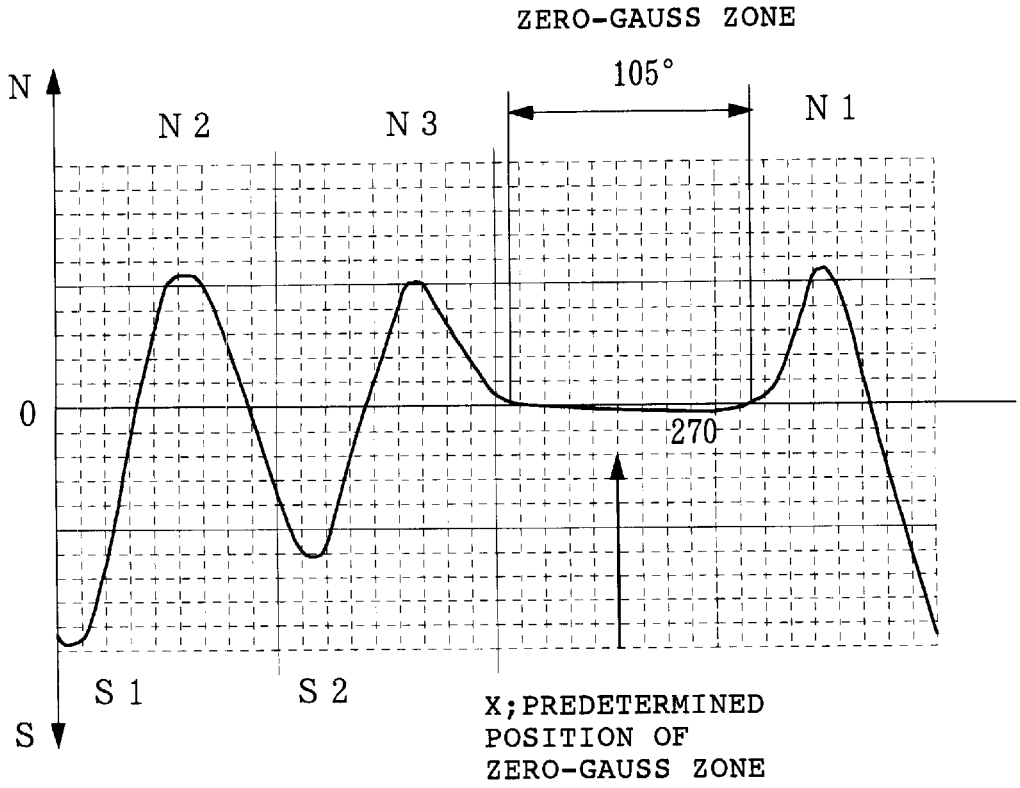
FIG. 13 is a diagram showing the magnetization pattern of the magnet roller according to Embodiment 3 of the present invention.

In the above Embodiment 2, the joint 30X between magnet pieces is located at the design position X of the zero-gauss zone. When a magnet roller is to be constructed by joining together magnet pieces 31 to 35, as shown in FIG. 10, a magnet roller 13B having a wide zero-gauss zone can be obtained by forming a space 30Y between the adjacent magnet pieces 31 and 35 of two magnetic poles at the design position X. FIG. 11 shows the magnetization pattern of the above magnet roller 13B. When the angle of the space 30Y is, for example, 30°, the width of the flat portion of the zero-gauss zone can be made approximately 35°. W the angle of the above space 30Y is 100° as shown in FIG. 12, a magnet roller 13C having a magnetization pattern in which the width of the flat portion of the zero-gauss zone is approximately 105° can be obtained as shown in FIG. 13.

Thus, the magnet rollers 13B and 13C having a wide zero-gauss zone can be obtained by forming the space 30Y at the design position X of the zero-gauss zone. Therefore, even when the poles are dislocated by differences at the time of molding, the dislocation of the zero-gauss zone can be eliminated without fail. As described above, the width of the obtained zero-gauss zone is substantially equal to the size of the space 30Y, the width of the above zero-gauss zone can be controlled by setting the size of the space 30Y properly.

Figure 14:
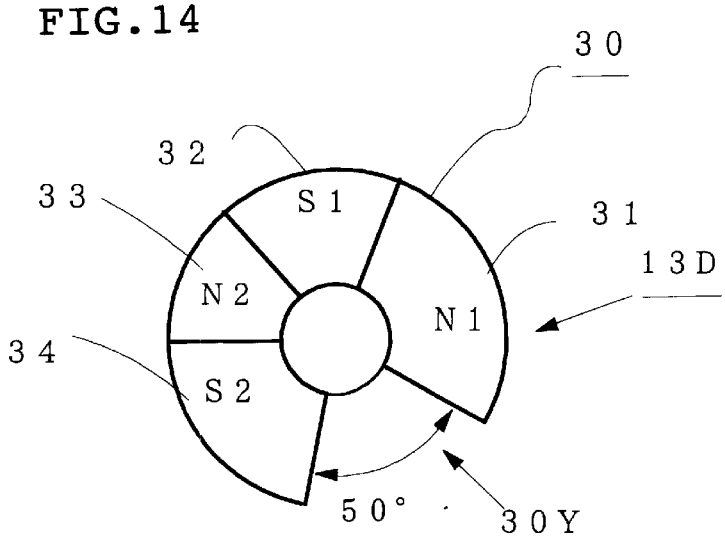
FIG. 14 is a front view showing the constitution of another magnet roller according to Embodiment 3 of the present invention.
Figure 15:
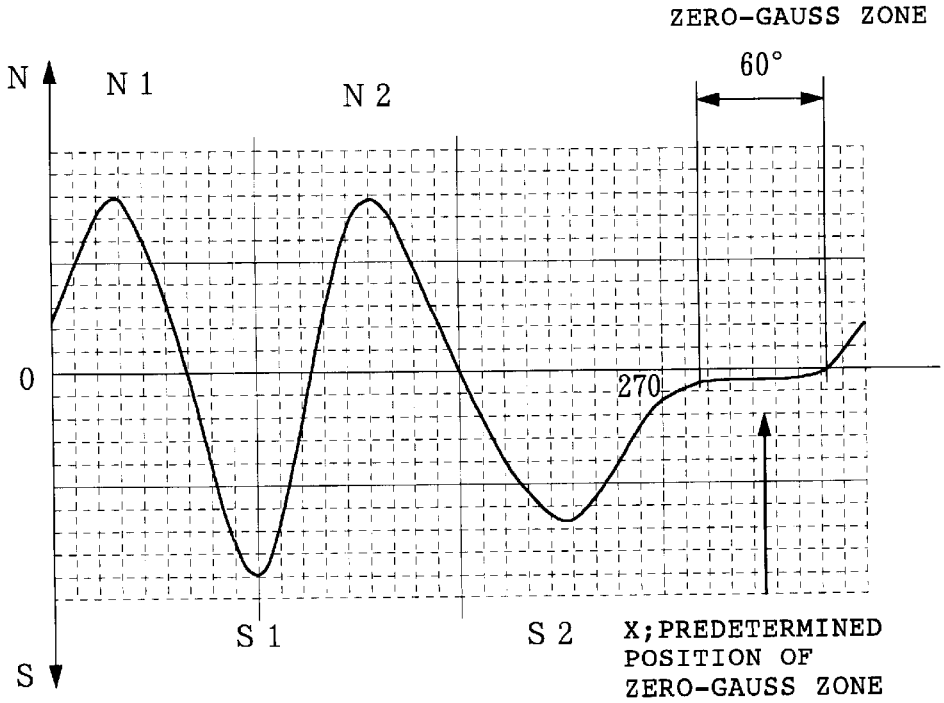
FIG. 15 is a diagram showing the magnetization pattern of the magnet roller according to Embodiment 3 of the present invention.
Figure 16:
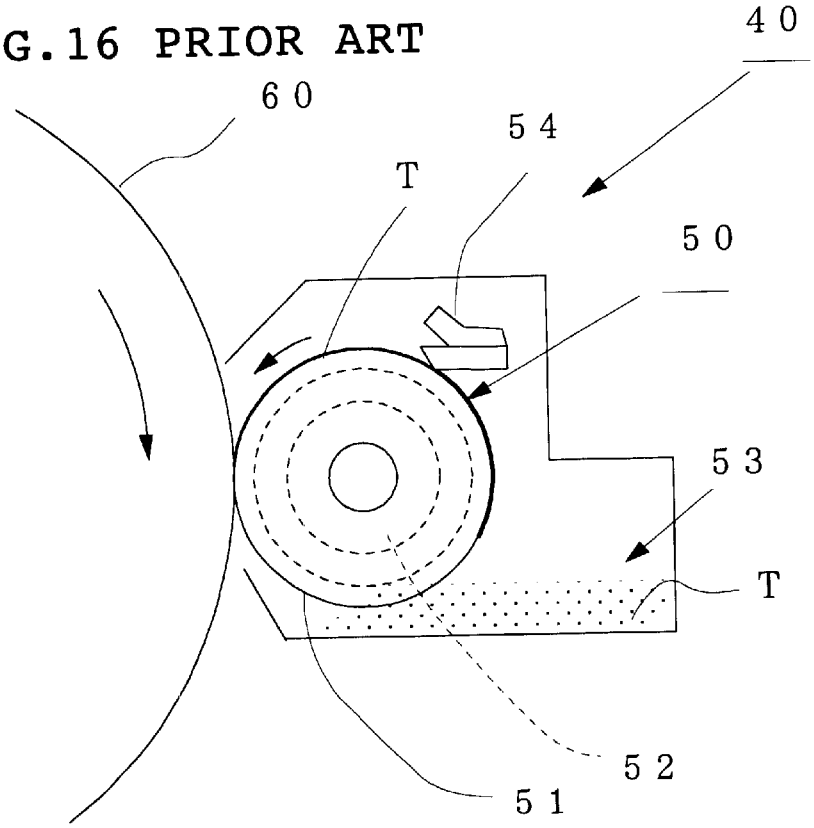
FIG.16 PRIOR ART
FIG. 16 is a diagram showing the constitution of a conventional developing device.
Figure 17:
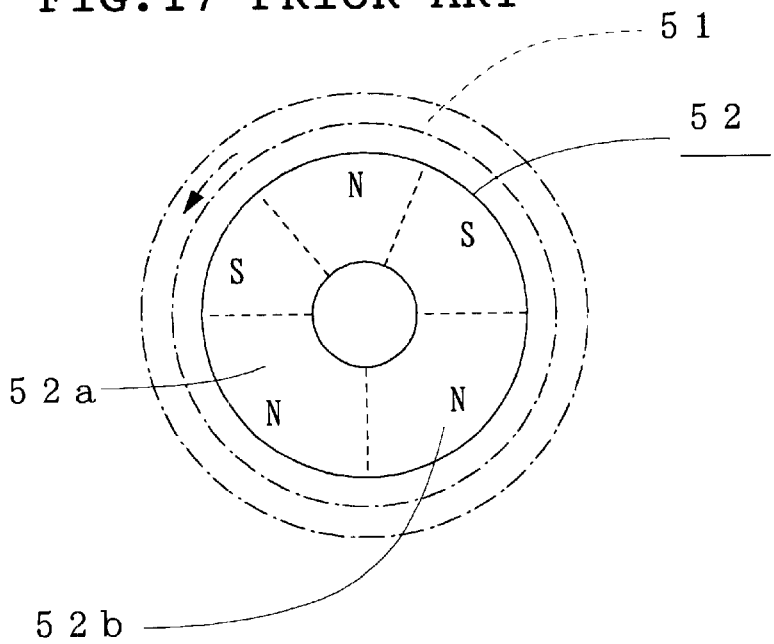
FIG.17 PRIOR ART
FIG. 17 is a diagram showing the constitution of a conventional magnet roller.

Even in the case of a magnet roller having an even number of poles, as shown in FIG. 14, a magnet roller 13D having a wide zero-gauss zone can be obtained by forming the space 30Y between the magnet pieces 35 and 31 (see FIG. 15).

In the above Embodiments 1 to 3, the magnet roller 13 having a magnetization pattern in which the design position X of the zero-gauss zone is halfway between the magnet piece 35 of the collection pole (N3 pole) and the magnet piece 31 of the sucking pole (N1 pole) has been described. Even when the design position of the zero-gauss zone is another position, a magnet roller having a magnetization pattern which rarely experiences the dislocation of the zero-gauss zone can be obtained by the same constitution as in the above embodiments. It is needless to say that even a magnet roller having a magnetization pattern with a plurality of zero-gauss zones can suppress the dislocations of the zero-gauss zones.

As described above, according to the present invention, since a change in magnetic force between adjacent magnetic poles having the same polarity is suppressed by forming a cut-out portion extending in an axial direction at the position of the zero-gauss zone of the magnet roller having a magnetization pattern with the zero-gauss zone between the adjacent magnetic poles having the same polarity and integrally molded out of a bond magnet composition, the position of the zero-gauss zone can be stabilized with simple constitution. At this point, the position of the zero-gauss zone can be further stabilized without fail by setting the size of the cross section of the above cut-out portion to 5% or more of the cross-sectional area of the magnet body.

The magnet roller obtained by joining together a plurality of bar-like magnet pieces whose outer magnetic poles have been made N or S poles by magnetization and whose section is fan-shaped, which rarely experiences the dislocation of the zero-gauss zone can be obtained by joining together the magnet pieces so that the joint 30 between magnet pieces is located at the design position of the zero-gauss zone or by forming a space at the design position of the zero-gauss zone.

Therefore, when the above magnet roller is used in a developing roller, for example, a clear image can be obtained.

What is claimed is:

1. A magnet roller which comprises a magnet body integrally molded out of a resin magnet composition prepared by mixing and dispersing magnetic powders in a resin binder and a shaft portion projecting from both ends in an axial direction of the magnet body and which has a magnetization pattern with a zero-gauss zone between a pair of magnetic poles having the same polarity which are adjacent to each other in a circumferential direction, wherein a cut-out portion extending in an axial direction is formed on the side of the magnet body at the predetermined position of the zero-gauss zone.

2. The magnet roller of claim 1, wherein the size of the cross section of the above cut-out portion is set to 5% or more of the cross-sectional area of the magnet body.

3. The magnet roller of claim 1, wherein an area having a difference of 40 gauss or less from the minimum magnetic force point of the magnetization pattern is 30° or less in terms of the angle of the roller in the above zero-gauss zone.

4. The magnet roller of claim 1, wherein the number of magnetic poles of the magnetization pattern is an odd number.

5. A magnet roller which comprises a magnet body constructed by arranging in a circumferential direction a plurality of magnet pieces molded out of a resin magnet composition prepared by mixing and dispersing magnetic powders in a resin binder and shaft portions projecting from both ends in an axial direction of the magnet body and which has a magnetization pattern with a zero-gauss zone between a pair of magnet pieces adjacent to each other in a circumferential direction, wherein the magnet pieces are arranged in such a manner that a space is formed between the above adjacent magnet pieces of two magnetic poles and located at the predetermined position of the zero-gauss zone.

6. The magnet roller of claim 1, wherein rare earth alloy powders are used as the magnetic powders.

7. The magnet roller of claim 6, wherein the rare earth alloy powders are anisotropic rare earth alloy powders.

8. The magnet roller of claim 7, wherein the anisotropic rare earth alloy powders are any one of anisotropic Sm—Fe—N alloy powders and Nd—Fe—B alloy powders or a mixture thereof.

* * * * *